US007175801B2

(12) United States Patent
Rak et al.

(10) Patent No.: US 7,175,801 B2
(45) Date of Patent: Feb. 13, 2007

(54) METHOD FOR PRODUCING A POROUS TITANIUM MATERIAL ARTICLE

(75) Inventors: Zbigniew Rak, Alkmaar (NL); Louis David Berkeveld, Schoorl (NL); Gerrit Snijders, Petten (NL)

(73) Assignee: Stichting Energieonderzoek Centrum Nederland, Petten (NL)

( * ) Notice: Subject to any disclaimer, the term of this patent is extended or adjusted under 35 U.S.C. 154(b) by 0 days.

(21) Appl. No.: 10/513,294

(22) PCT Filed: May 5, 2003

(86) PCT No.: PCT/NL03/00327

§ 371 (c)(1),
(2), (4) Date: Nov. 3, 2004

(87) PCT Pub. No.: WO03/092933

PCT Pub. Date: Nov. 13, 2003

(65) Prior Publication Data

US 2005/0175495 A1 Aug. 11, 2005

(30) Foreign Application Priority Data

May 3, 2002 (NL) ..... 1020534

(51) Int. Cl.
*B22F 3/11* (2006.01)

(52) U.S. Cl. ..... 419/2

(58) Field of Classification Search ..... 419/2, 419/5

See application file for complete search history.

(56) References Cited

U.S. PATENT DOCUMENTS

| | | | | |
|---|---|---|---|---|
| 2,254,549 A | | 9/1941 | Louis | |
| 3,950,166 A | | 4/1976 | Obara et al. | |
| 4,206,516 A | | 6/1980 | Pilliar | |
| 5,349,922 A | * | 9/1994 | Anthony et al. | 117/204 |
| 5,863,398 A | | 1/1999 | Kardokus et al. | |

FOREIGN PATENT DOCUMENTS

| | | | |
|---|---|---|---|
| GB | 1 004 352 | | 9/1965 |
| GB | 2 019 442 | | 10/1979 |
| JP | 50027706 A | * | 3/1975 |
| JP | 10030136 A | * | 2/1998 |
| JP | 10088253 A | * | 4/1998 |
| JP | 2000017301 | * | 1/2000 |
| NL | 6 909 116 | | 12/1970 |
| WO | WO 02/066693 | | 8/2002 |

OTHER PUBLICATIONS

Patent Abstracts of Japan, vol. 2000, No. 04, Aug. 31, 2000 & JP 2000 017301 A (Aichi Steel Works Ltd; Aichi Prefecture), Jan. 18, 2000 abstract.

Database WPI, Section Ch, Week 199406 Derwent Publications Ltd., London, GB; AN 1994-045645 XP002229439 & JP 06 002006 A (Japan Metals & Chem Co Ltd), Jan. 11, 1994 abstract.

* cited by examiner

*Primary Examiner*—Roy King
*Assistant Examiner*—Kathleen A. McNelis
(74) *Attorney, Agent, or Firm*—Young & Thompson

(57) ABSTRACT

Method for producing a porous titanium material for example a support. Starting from a titanium powder this powder is sintered under vacuum conditions in an inert/reducing atmosphere. Titanium hydride is added as powder and decomposes during sintering. The hydride ions provide a very reducing atmosphere preventing any titanium oxide or carbide/nitride composition to be formed at elevated temperature.

10 Claims, No Drawings

METHOD FOR PRODUCING A POROUS TITANIUM MATERIAL ARTICLE

BACKGROUND OF THE INVENTION

The subject invention relates to a method for producing a porous titanium material article. Porous means a porosity between 10 and 90 vol. %.

Such an article can comprise both a 3-dimensional and a 2-dimensional article. As example for a 2-dimensional product a support for a photocatalyst is given or a product in which a large surface area is required. Other non exhaustive examples are electrodes, capacitors, fuel cells, electrolysers, structural parts and the like.

Processing massive titanium is generally known in the art and no difficulties are encountered presently.

This is different for producing porous titanium. It is possible to obtain porous titanium which has however a very limited strength. In the above applications high porosity, high surface area; corrosion resistance and weight are of importance as well as good mechanical properties.

In the prior art porous titanium has been produced by sintering titanium metal powder. At elevated sintering temperature the titanium powder is very sensitive to a clean atmosphere during processing. It has been found that titanium powder is very aggressive at elevated temperature resulting in a surface layer for example a titanium oxide or titanium carbide layer. As soon as such a layer or an other layer is formed sintering is hampered because adhesion of adhesive powder particles is impaired.

To solve this problem it is proposed in the prior art to add hydrogen gas during sintering. In this way a reducing atmosphere can be obtained. However it has been found that even if hydrogen is added as a gas still sintering of powder particles is far from optimum resulting in poor mechanical properties of the final porous product.

U.S. Pat. No. 4,206,516 discloses a method for providing a porous surface layer on a cast titanium substrate. To that end a slurry of pure titanium hydride is provided on the substrate. By thermal decomposition titanium hydride particles convert in titanium metal. The slurry is provided by spraying. Because pure titanium hydride particles are used, quite some shrinkage is to be expected after sintering.

U.S. Pat. No. 2,254,549 discloses a composition comprising 60–90% of a base metal not being titanium, a low melting temperature binder, which can comprise copper and titanium and metal hydride. The binder will be present in the final product.

U.S. Pat. No. 3,855,638 discloses a surgical prosthetic device whereon a solid metallic material substrate a porous coating is adhered. The coating is realized starting from an aqueous slurry which is dried and sintered in a hydrogen atmosphere.

U.S. Pat. No. 3,855,638 discloses a surgical prostetic device whereon a solid metallic material substrate a porous coating is adhered. The coating is realised starting from an aqueous slurry which is dried and sintered in a hydrogen atmosphere.

U.S. Pat. No. 3,950,166 discloses the use of either titanium or titanium hydride and no mixtures thereof. The abstract of the Japanese patent specification 2000-017301 discloses a sintered compact which is not porous because of a higher than 95% sintered density. A high percentage (35–95 wt %) titanium hydride powder is added to titanium powder.

U.S. Pat. No. 5,863,398 discloses a method for realising an object by sputtering.

The subject invention aims to provide an improved method for producing a titanium material article having increased mechanical properties.

SUMMARY OF THE INVENTION

Surprisingly it has been found that through the use of 0.01–10 wt % titanium hydride improved sintering characterisics and so improved mechanical properties of the porous product are obtained. It is assumed that this is caused by the fact that during the sintering process titanium hydride decomposes at relatively low temperature and very aggressive free hydride ions result adhering to any non-titanium component present at sintering. This prevents titanium compositions to be formed at the surface of the titanium powder material so that a clean titanium powder material is subjected to sintering at elevated temperature resulting in optimum sintering results.

Problems with shrinkage have not been observed. This means that this method is in particular useful for making two dimensional articles. An example is a support for a photocatalyst and electro catalyst. Such a support should have considerable mechanical strength and a high porosity at low thickness. As example a thickness between 50 μm en 2 mm is mentioned. This weight percentage is related to the total powder material used during sintering.

Titanium hydride decomposes at relatively low temperature at about 288° C. and any contaminants present such as oxygen or carbon are intercepted by free hydrides (hydrogen ions) resulting. A further advantage of the method according to the invention is that it is possible to keep the temperature of sintering relatively low for example below 1000° C. The sintering process lasts between 1 and 1000 minutes in particular about 0.5–1 hour. It is possible with the method according to the invention to accurately adjust the porosity of the product to be obtained.

According to a further preferred embodiment of the invention an organic binder is provided which will evaporate during sintering or is fired in previous step. As indicated above any carbon resulting having the tendency to react with titanium is catched away by hydrogen ions. In contrast to metal binders such an organic binder is only used for giving shape to the article and is completely removed at sintering.

Vacuum is adjusted according to requirement and will be generally between 0.1 and 10 exp.(−6) atmosphere i.e. relatively low.

If 3D-articles are to be produced according to an embodiment of the invention a foam is provided which is impregnated with the titanium metal—titanium hydride powder after this powder is brought into suspension. The foam is fired and the subsequent structure is subjected to a sintering step. An other proposal is to subject the powder mixture to a pressing step before sintering. This pressing step can be uni-axial or can comprise cold isostatic pressure. Preferably pure titanium (grade 1–12) is used.

According to a further preferred embodiment the pressed article is sintered on a substrate. Said substrate can comprise a molybdenum plate, which is coated with a (hexagonal) boron nitride spray for improved adhesion. Other techniques for producing a sponge titanium structure are feasible. For 2-dimensional products tape casting is a possibility. During tape casting a casting paste is produced from pure titanium powder, titanium hydride and an organic binder. Foil/tape are cast for example with a doctor blade on a non-adhesive flat support such as a flat Teflon support. Subsequently the binder is removed by heating up to 600° C. without the presence of oxygen. Carbon is made ineffective by the effect of decomposing titanium hydride. Subsequently the foil/tape is sintered in the presence of reducing agent.

The titanium material can be one of the materials as mentioned above. The organic binder can be an organic polymer binder such as polyvinyl butyral, meth-acrylate emulsion, etc. or one or more organic solvents (ethanol, isopropanol, toluene, terpineol etc.), organic dispersant (Menhaden oil, Corn oil, Glycerol trioleate, glycerol tristearate, oleic acid etc.), organic plasticiser (glycerine, dibuthyl phtalate, polyethylene glycol etc), release agent (stearic acid, etc), homogenizer (diethyl ether, cyclohexane, etc).

After preparing a foil/tape on a non-adhesive surface solvent it can be dried at room temperature in air and excess solvent can be removed. The dry tape/foil can easily be removed from the supporting surface and cut to the required dimension. The mechanical strength is sufficient for transferral. Subsequently the tape/foil is supported on a metal such as molybdenum or tungsten coated with hexagonal BN suspension or zirconia powders suspension and then heat-treated in a neutral atmosphere up to 600° C. to pyrolyse all organic components. During this heating titanium hydride and more particular hydride become effective. Subsequently sintering is realised in a temperature range of 600–1600° C. in either a neutral atmosphere (argon, nitrogen) or a reducing atmosphere with hydrogen and an inert gas at more or less lowered pressure.

DETAILED DESCRIPTION OF THE PREFERRED EMBODIMENTS

The invention will be further elucidated referring to some examples.

I. In a First Example Dense 3D-Titanium Objects Such as Cylinders were Produced.

Titanium powder (−325 mesh) was mixed with 7 wt % solution of PVA polymer (20 wt % concentration) and cylinders of 300 mm in diameter and 10 mm high were pressed in an uniaxial press under a pressure of 100 MPa. The samples were dried at the temperature of 80° C. for 2 h in an oven and then sintered in a vacuum oven on the molybdenum plate coated with a thin layer of hexagonal boron nitride. The sintering process was performed in a vacuum oven at 1300° C. for 2 h in the presence of the $TiH_2$ reducing agent in the quantity of 0.1 wt % to the total weight of the sample.

II. In a Further Example Porous 3-Dimensional Titanium Objects Such as Cubes were Produced.

A 40 vol. % aqueous slurry of titanium powder was prepared using as raw material the titanium powder (−325 mesh), water as a solvent and 5 wt % methylcellulose as a binder. The viscosity of the titanium slurry was approximately 2 cPa·s. The cubic shape samples of sizes 2.5×2.5×2.5 $cm^3$ from the polyurethane foam with 20 ppi were impregnated with the slurry. The excess of slurry was squeezed from the samples in a rolling press. The samples were dried at the temperature of 85° C. for 2 h in an electrically heated oven and then sintered in a vacuum oven in the presence of $TiH_2$ (reducing agent) at 1000° C. for 1 h. The shrinkage of samples was in the range of 15–16%, density of 0.45 $g/cm^3$ and open porosity of 90 vol %.

III. In a Third Example a Porous 2-Dimensional Titanium Object was Produced.

a) Preparation

Composition of the paste for tape casting:

| | |
|---|---|
| titanium powder (−325 mesh) | 55 wt % |
| titanium hydrate | 0.01 wt % |
| binder system B-33305 (from FERRO) | 45 wt % |

(Polyvinyl Butyral based binder system using toluene/ethanol solvents; binder solids —22.4 wt %, resin/plasticizer ratio —1.7:1, Viscosity —450 cPs).

All components of the paste were mixed by shaking in a Turbula mixer for 45 min. and then tape casted on the glass plate coated with Teflon tape. The viscosity of the binder system was approximately 450 cPa·s. The doctor blade system was used for forming a tape with the thickness of 0.5 mm and width of 30 cm.

The tape was dried in ambient atmosphere for 4 hours and then 1 hour in an oven at the temperature of 60° C.

The tape was cut for samples of sizes 12×12 $cm^2$. The samples were located on the molybdenum plates coated with hexagonal BN spray and then sintered in an electric oven between two Mo plates separated by spacers under vacuum at a temperature of 1000° C. for 1 hour. The rate of heating: 200° C./h, rate of cooling: together with the oven.

Although the invention has been elucidated above referring to preferred embodiments of the invention after the above description a person skilled in the art will immediately realise further embodiments which are obvious after the above and within the range of the appended claims.

The invention claimed is:

1. Method for producing a porous titanium material article, comprising the provision of titanium powder as base metal and titanium hydride powder in a slurry as a powder mixture, sintering said powder mixture on at least 1000° C., said slurry comprising an organic binder comprising an organic solvent, sintering is effected under vacuum conditions and in that 0.01–0.10 wt % titanium hydride is provided.

2. Method according to claim 1, wherein said powder comprises an organic binder.

3. Method according to claim 1, wherein an organic foam is impregnated with said powder being brought into suspension.

4. Method according to claim 1, wherein said powder is subjected to a pressing step before sintering.

5. Method according to claim 4, wherein the pressed article is sintered on a substrate.

6. Method according to claim 5, wherein said substrate comprises a molybdenum substrate.

7. Method according to claim 6, wherein said molybdenum substrate is coated with a hexagonal BN or zirconia layer.

8. Method according to claim 1, wherein a titanium powder/organic binder paste is prepared and said powder is coated on a substrate resulting in a combination.

9. Method according to claim 8, wherein said combination is subjected to a heating step up to 1000° C. after which the substrate is removed and the foil/tape obtained is subjected to sintering.

10. Method according to claim 8,comprising tape casting.

* * * * *